US005117603A

United States Patent [19]

Weintraub

[11] Patent Number: 5,117,603

[45] Date of Patent: Jun. 2, 1992

[54] FLOORBOARDS HAVING PATTERNED JOINT SPACING AND METHOD

[76] Inventor: Fred I. Weintraub, 1569 Deer Hollow Dr., Toms River, N.J. 08753

[21] Appl. No.: 617,569

[22] Filed: Nov. 26, 1990

[51] Int. Cl.[5] ..... E04F 13/08; E04B 9/00

[52] U.S. Cl. ..... 52/390; 52/392; 52/479

[58] Field of Search ..... 52/390, 391, 392, 479, 52/480

[56] References Cited

U.S. PATENT DOCUMENTS

| | | | |
|---|---|---|---|
| 753,791 | 3/1904 | Fulghum | 144/319 |
| 3,436,888 | 4/1969 | Ottosson | 52/480 |
| 3,515,620 | 6/1970 | McPherson | 161/38 |
| 4,128,119 | 12/1978 | Maier | 144/317 |
| 4,401,496 | 8/1983 | Koontz, Jr. | 156/182 |
| 4,565,597 | 1/1986 | Schulte | 156/250 |

*Primary Examiner*—David A. Scherbel
*Assistant Examiner*—Kien Nguyen
*Attorney, Agent, or Firm*—Lerner, David, Littenberg, Krumholz & Mentlik

[57] ABSTRACT

An elongated floorboard is formed by finger jointing together in endwise fashion a plurality of relatively short sections of wood. The finger joints are formed at an oblique angle to the elongation direction of the floorboards to provide a repetitive series of visible joining lines. Floorboards having their joining lines in different orientations may be arranged adjacent to one another in various combinations to form floors having a variety of different patterns.

17 Claims, 2 Drawing Sheets

FLOORBOARDS HAVING PATTERNED JOINT SPACING AND METHOD

FIELD OF THE INVENTION

The present invention relates to the formation of elongated floorboards from individual sections of wood and, more particularly, to such floorboards wherein the sections are connected to form a patterned joint spacing. In addition, the present invention relates to the arrangement of such floorboards to form floors having unique patterns.

BACKGROUND OF THE INVENTION

Hardwood flooring has long been an elegant and desirable floor covering for use in homes. Such flooring typically consists of elongated strips of lumber arranged adjacent to one another and nailed in place to cover a selected area. In order to provide the beautiful appearance typical of hardwood floors, the strips of lumber must be carefully chosen to be defect free. Hence, only lumber of the highest quality may be used for such flooring. As the availability of this high-quality lumber began to dwindle, it was inevitable that hardwood flooring would become more expensive. Today, the cost of such flooring is so prohibitive that it is not economically feasible to provide less costly homes with hardwood floors.

Any attempt to produce floorboards from an inferior-quality lumber would result in an aesthetically unappealing product. Thus, inferior lumbers contain defects which must be removed before the lumber can be used as a flooring material. Since the defects occur at random locations throughout the lumber, the most efficient use of the lumber results in the formation of floorboards having a variety of random lengths. Many of these lengths are extremely short and essentially unusable, therefore becoming scrap material.

There therefore exists a need for a floorboard which is aesthetically pleasing but sufficiently inexpensive that it may be used to provide hardwood floors in even less costly homes. In particular, the needs exists for a floorboard which may be produced from lumber of an inferior quality while, at the same time, making efficient use of such lumber with minimal waste.

SUMMARY OF THE INVENTION

In accordance with one aspect of the present invention, these needs have now been addressed by the invention of a floorboard consisting of a plurality of elongated sections each having a preselected length, the plurality of sections connected to one another in endwise fashion to form a continuous strip in an elongation direction, the connection between adjacent ones of the plurality of sections forming a joint having a distinct line at an oblique angle to the elongation direction. Preferably, the plurality of sections are connected by finger joints.

In one embodiment, the preselected lengths of each of the sections are equal.

In another embodiment, the distinct lines in the floorboard are all at equal oblique angles to the elongation direction. Preferably, all of the oblique angles are about 45 degrees.

In more preferred embodiments, the distinct lines include a shallow channel formed coextensively therewith so that the distinct lines are more pronounced.

Preferred embodiments of this aspect of the present invention provide elongated floorboards having a desirable aesthetic appearance, but which may be produced with minimal waste from lumber of an inferior quality. Moreover, the preferred floorboards according to the present invention may be constructed using known joining techniques which are readily performed and economical.

In accordance with another aspect of the present invention, a floor is provided by arranging a plurality of floorboards adjacent to one another to form a planar assembly, each of the plurality of floorboards comprising a plurality of elongated sections each having a preselected length, the plurality of sections connected to one another in endwise fashion to form a continuous strip in an elongation direction, the connection between adjacent ones of the plurality of sections forming a joint having a distinct line transverse to the elongation direction, the distinct line in at least some of the plurality of floorboards being disposed at an oblique angle to the elongation direction. Preferably, the plurality of sections are connected by finger joints.

In one embodiment, the distinct lines in any one of the floorboards are all at equal oblique angles to the elongation direction.

In another embodiment, the distinct lines in each of the floorboards are all at equal oblique angles to the elongation direction, preferably at 45 degree oblique angles.

In yet another embodiment, the preselected lengths of the sections in any one of the floorboards are equal. Preferably, the preselected lengths of the sections in all of the floorboards are equal.

In preferred embodiments, the distinct lines on adjacent floorboards intersect one another to form a pattern. In highly preferred embodiments, the oblique angles in ones of the floorboards are in a direction opposite to the oblique angles in others of the floorboards.

Preferred embodiments of this aspect of the present invention provide floors for either indoor or outdoor use in which a variety of different patterns may be achieved.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
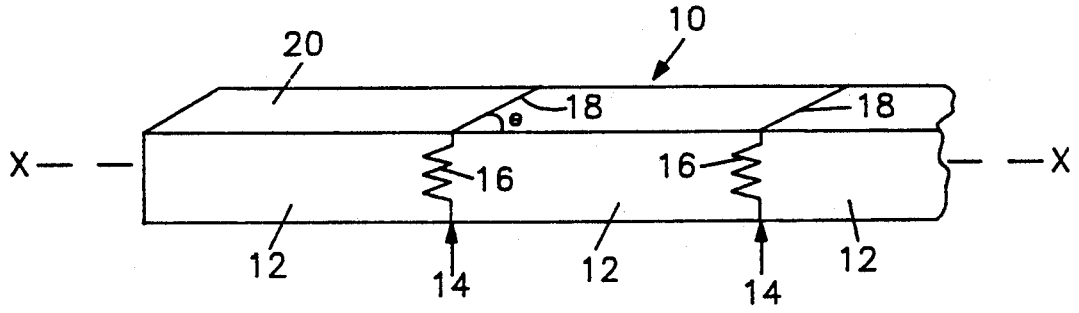
FIG. 1 is a partial perspective view of a floorboard of the present invention.
Figure 2:
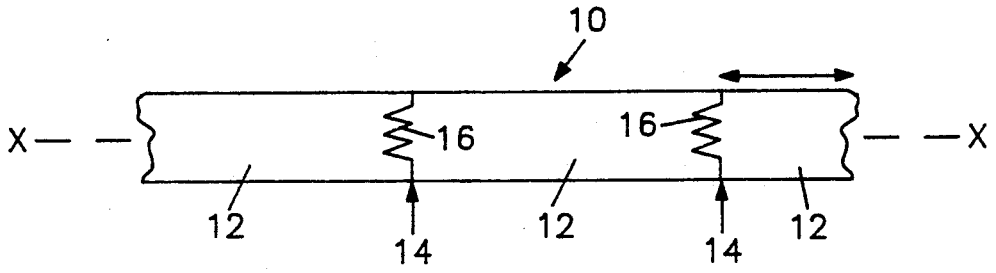
FIG. 2 is a partial front view of the floorboard shown in FIG. 1.
Figure 3:
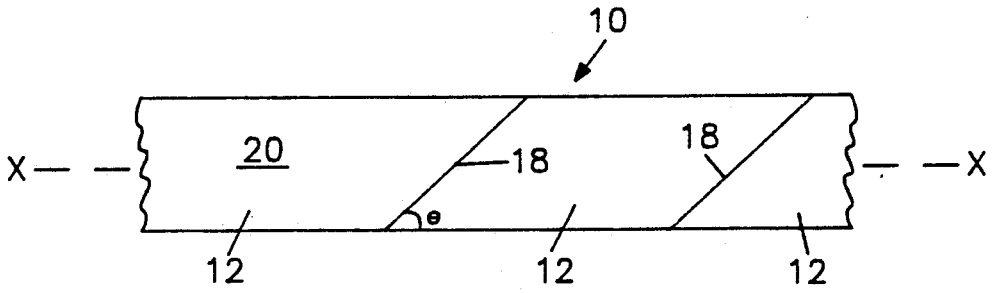
FIG. 3 is a partial plan view of the floorboard shown in FIG. 1.

Referring to FIGS. 1-3, there is illustrated one preferred embodiment of a floorboard 10 in accordance with the present invention. Floorboard 10 is formed from a plurality of relatively short sections of wood 12 having substantially the same width and thickness which are joined together in endwise fashion to form a floorboard having a desired length. Although the particular species of wood from which sections 12 are formed is not critical to the present invention, the use of hardwoods which will resist scratching and denting is preferred. Moreover, it is generally preferred that all of the sections 12 in a single floorboard 10 be derived from the same species of wood so as to have the same color, grain pattern and other aesthetic qualities throughout. When desired, however, different species of wood may be used in a single floorboard to achieve a desired effect, such as an alternating light and dark pattern. It is also preferable that each section 12 in a single floorboard 10 be of the same length. However, as discussed more fully below, unique aesthetic effects can be obtained by assembling each floorboard 10 from a plurality of sections 12 having two or more different lengths.

Sections 12 may be formed from scraps of wood from a milling operation, or may be cut from elongated wood planks. In either case, sections 12 are cut to remove any defects therein and so that the ends thereof form an oblique angle $\theta$ with respect to the longitudinal direction of floorboard 10. As used herein, the longitudinal direction of floorboard 10 is the direction in which the sections 12 are assembled, as identified by axis X—X in the figures. Preferably, a 45 degree angle $\theta$ is formed between the ends of sections 12 and the longitudinal axis X—X of floorboard 10.

Sections 12 are joined together by any desired form of joint 14 having sufficient strength to resist the stresses which will be applied to the floorboard 10. One preferred joint, commonly referred to as a finger joint, is formed by providing the longitudinal ends of sections 12 with interlocking wedge-shaped tenons 16. Before assembly, sections 12 are kiln dried to remove the moisture therefrom and a strong adhesive is applied to the tenons 16 to hold sections 12 securely together. Where floorboards 10 are intended for an outdoor use, such as for a deck or porch, sections 12 are preferably assembled with a waterproof adhesive. Although finger jointing is a preferred expedient for joining sections 12 together, it will be readily apparent to one of ordinary skill in the art that other joining methods may readily be employed.

Figure 4:
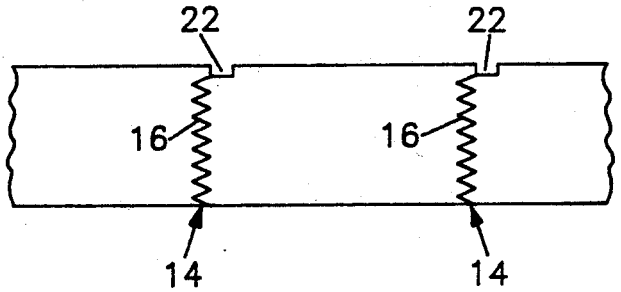
FIG. 4 is a partial front view of the floorboard of FIG. 1 showing a groove formed along each of the joints.
Figure 5:
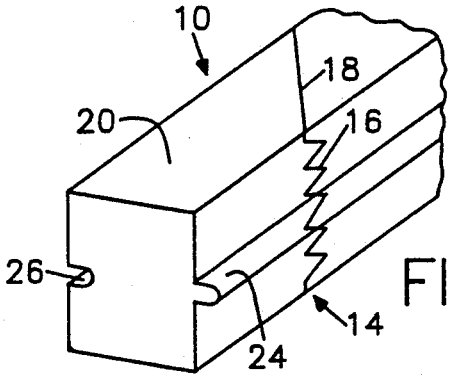
FIG. 5 is a partial perspective view of another floorboard of the present invention illustrating a tongue and groove formed on the longitudinal edges thereof.

Once joints 14 have been cured to a sufficient strength, floorboards 10 are dressed by planing and/or sanding to remove any excess adhesive and achieve a uniform width and thickness throughout. It is an important feature of the present invention that, after the final dressing operation, a joining line 18 along each joint 14 be visible on the upper surface 20 of floorboard 10, that is, the surface of the floorboard 10 which will be exposed when a plurality of floorboards 10 are assembled to form a floor. In order to insure the visibility of joining lines 18, or in order to make joining lines 18 more pronounced, a shallow channel 22 may optionally be cut along that portion of joint 14 which is evident in the upper surface 20 of floorboards 10. Channel 22 may be formed with a rectangular profile, as shown in FIG. 4, or alternatively with those profiles which result from making V-cuts or beading cuts in surface 20.

In those cases where floorboards 10 are fabricated for indoor use, the longitudinal edges thereof are provided with a conventional tongue 24 and groove 26 as is generally known in the art, the tongue 24 of one floorboard 10 being shaped to mate with the groove 26 of an adjacent floorboard 10 to provide enhanced structural integrity and a neat appearance when the floorboards 10 are assembled to form a floor. On the other hand, when floorboards 10 are fabricated for outdoor use, there is no need to provide them with a tongue 24 and groove 26 inasmuch as the floorboards 10 are typically assembled with a slight gap between each in such applications to allow for water drainage.

Figure 6:
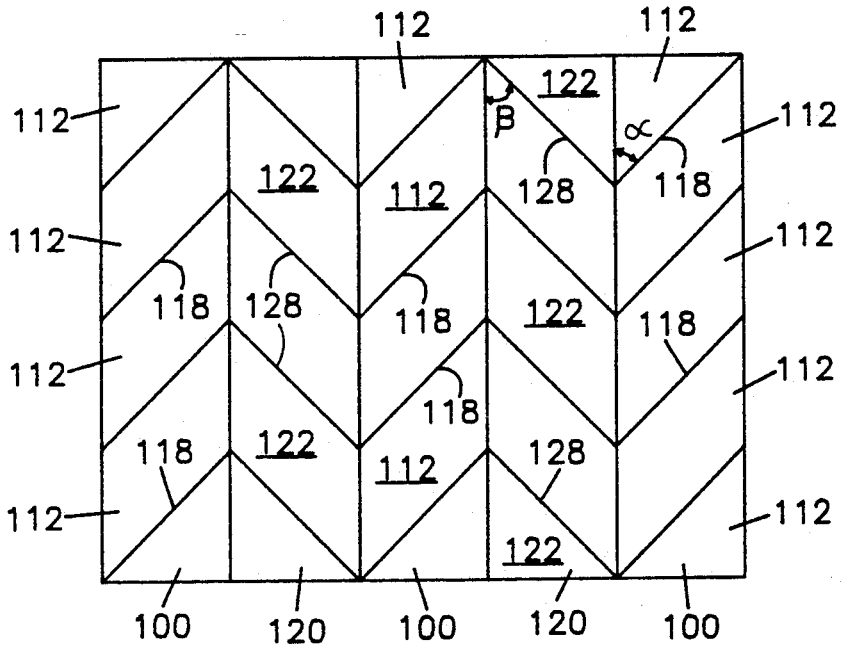
FIG. 6 is a plan view showing a plurality of the floorboards of the present invention arranged with the joining angle on adjacent boards going in opposite directions.
Figure 7:
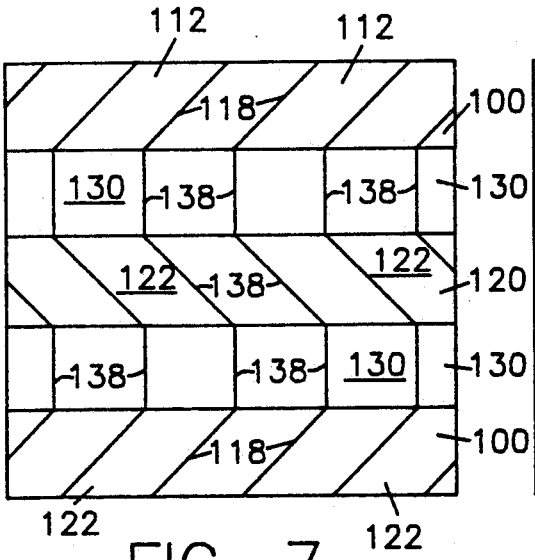
FIG. 7 is a plan view showing a plurality of the floorboards of the present invention arranged in an alternating pattern with floorboards having perpendicular joints.
Figure 8:
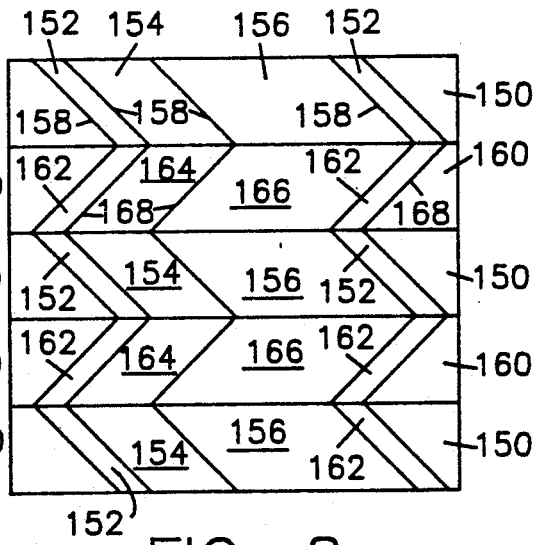
FIG. 8 is a plan view showing a plurality of the floorboards of the present invention formed with sections of unequal length.

When laying a floor using floorboards made in accordance with the present invention, a large variety of aesthetically pleasing patterns can be obtained. Representative examples of these patterns are shown in FIGS. 6-8. Referring to FIG. 6, a well-known herringbone pattern is illustrated. This pattern is achieved by alternately assembling two different groups of floorboards. In the first group, identified as floorboards 100, the sections 112 are all the same length and the joining lines 118 are disposed at a first oblique angle $\alpha$ with respect to the longitudinal direction of the floorboards. In the second group, denoted floorboards 120, all the sections 122 are the same length as the sections 112 in floorboards 100. In floorboards 120, however, the joining lines 128 travel at an oblique angle $\beta$ to the longitudinal direction of the floorboards which is opposite to the oblique angle $\alpha$ in floorboards 100. For instance, if joining lines 118 are formed at a $-45$ degree angle to the longitudinal direction of the floorboards, joining lines 128 will be formed at a $+45$ degree angle to that direction. In accordance with the present description, oblique angles having a positive value are measured in a counterclockwise direction from a reference line parallel to the longitudinal direction of a floorboard to a joining line, while oblique angles having a negative value are measured in a clockwise direction from the same reference line to a joining line. The herringbone pattern shown in FIG. 6 is thus obtained by alternately assembling floorboards 100 and 120 so that the joining lines in adjacent floorboards intersect.

A variety of other floor patterns may be achieved with floorboards 100 and 120 by simply arranging the floorboards in different combinations. For instance, by assembling floorboards 100 adjacent to one another so that the joining lines in adjacent floorboards intersect, a floor having parallel diagonal lines will be formed. A similar pattern in which the diagonal lines travel in the opposite direction can be obtained by assembling floorboards 120 in a similar fashion. Moreover, a herringbone pattern that is wider than that shown in FIG. 6 can be achieved by alternately assembling groups of two or more adjacent floorboards 100 with groups of the same number of adjacent floorboards 120 so that the joining lines in all adjacent floorboards intersect.

A second pattern, shown in FIG. 7, may be obtained by interspersing floorboards 130 between floorboards 100 and 120, arranged as in the herringbone pattern shown in FIG. 6, so that the joining lines in adjacent floorboards intersect. The joining lines 138 in floorboards 130 are disposed perpendicularly to the longitudinal direction of the floorboards and separate sections 132, each of which has a length equal to the distance between joining lines 118 or 128 as measured in the longitudinal direction of the floorboards. As above, a variety of different floor patterns may be developed by simply varying the arrangement in which floorboards 100, 120 and 130 are assembled.

A third pattern, in which the floorboards 150 and 160 are formed from sections having different lengths, is shown in FIG. 8. Thus, floorboards 150 consist of sections 152, 154 and 156 having progressively greater lengths. Sections 152, 154 and 156 are separated by joining lines 158 which are disposed at a first oblique angle with respect to the longitudinal direction of the floorboards. Floorboards 160 are assembled from sections 162, 164 and 166 which have the same lengths as sections 152, 154 and 156, respectively, but which are separated by joining lines 168 which travel at an oblique angle to the longitudinal direction of the floorboards which is opposite to the oblique angle of joining lines 158 in floorboards 150. Thus, by alternating floorboards 150 and 160 so that the joining lines in adjacent floorboards intersect, a modified herringbone pattern similar to that described above in connection with FIG. 6 may be obtained. It will be readily apparent that a multitude of patterns and effects can be obtained by varying the lengths of the individual segments and the order in which they are assembled.

Although the invention herein has been described with reference to particular embodiments, it is to be understood that these embodiments are merely illustrative of the principles and applications of the present invention. For example, floors having other desired patterns may be obtained by arranging the floorboards of the present invention so that the joining lines of adjacent floorboards do not intersect, or by assembling floors from floorboards having their joining lines formed at different oblique angles. It is therefore to be understood that numerous modifications may be made to the illustrative embodiments and that other arrangements may be devised without departing from the spirit and scope of the present invention as set forth in the appended claims.

I claim:

1. A floorboard comprising, a plurality of elongated sections each having a preselected length in an elongation direction between a first end and a second end and a uniform width, said uniform width in each of said plurality of sections being substantially equal, said plurality of sections being connected to one another with one of said ends of one section connected to one of said ends of another section to form a continuous linear strip in said elongation direction, said strip having substantially straight parallel side edges extending in said elongation direction and spaced apart by said uniform width, said connection between adjacent ones of said plurality of sections forming a joint having a distinct line and an oblique angle to said elongation direction.

2. A floorboard as claimed in claim 1 wherein said preselected lengths of each of said sections are equal.

3. A floorboard as claimed in claim 1 wherein said plurality of sections are connected by finger joints.

4. A floorboard as claimed in claim 1 wherein said distinct lines are all at equal oblique angles to said elongation direction.

5. A floorboard as claimed in claim 4 wherein said oblique angles are about 45°.

6. A floorboard as claimed in claim 1 wherein said distinct lines include a shallow channel formed coextensively therewith.

7. A floor comprising, a plurality of floorboards arranged adjacent to one another to form a planar assembly, each of said plurality of floorboards comprising a plurality of elongated sections each having a preselected length in an elongation direction between a first end and a second end and a uniform width, said uniform width in each of said plurality of sections being substantially equal, said plurality of sections being connected to one another with one of said ends of one section connected to one of said ends of another section to form a continuous linear strip in said elongation direction, said strip having substantially straight parallel side edges extending in said elongation direction and spaced apart by said uniform width, said connection between adjacent ones of said plurality of sections forming a joint having a distinct line transverse to said elongation direction, said distinct line in at least some of said plurality of floorboards being disposed at an oblique angle to said elongation direction.

8. A floor as claimed in claim 7 wherein said plurality of sections are connected by finger joints.

9. A floor as claimed in claim 7 wherein said distinct lines in any one of said floorboards are all at equal oblique angles to said elongation direction.

10. A floor as claimed in claim 9 wherein said distinct lines in each of said floorboards are all at equal oblique angles to said elongation direction.

11. A floor as claimed in claim 10 wherein said oblique angles are about 45°.

12. A floor as claimed in claim 7 wherein said preselected lengths of said sections in any one of said floorboards are equal.

13. A floor as claimed in claim 12 wherein said preselected lengths of said sections in all of said floorboards are equal.

14. A floor as claimed in claim 7 wherein said distinct lines on adjacent floorboards intersect one another to form a pattern.

15. A floor as claimed in claim 14 wherein said oblique angles in ones of said floorboards are in a direction opposite to said oblique angles in others of said floorboards.

16. A method for forming a floorboard comprising, providing a plurality of sections each having a preselected length in an elongation direction between a first end and a second end and a uniform width, said uniform width in each of said plurality of sections being substantially equal, and connecting said plurality of sections to one another with one of said ends of one section connected to one of said ends of another section to form a continuous linear strip in said elongation direction, said strip having substantially straight parallel side edges extending in said elongation direction and spaced apart by said uniform width, the connection between adjacent ones of said plurality of sections forming a joint having a distinct line at an oblique angle to said elongation direction.

17. A method as claimed in claim 16 wherein said step of connecting said plurality of sections to one another comprises finger jointing said plurality of sections to one another.

* * * * *